US010636405B1

(12) United States Patent
Kemmerer

(10) Patent No.: US 10,636,405 B1
(45) Date of Patent: Apr. 28, 2020

(54) AUTOMATIC ACTIVE NOISE REDUCTION (ANR) CONTROL

(71) Applicant: BOSE CORPORATION, Framingham, MA (US)

(72) Inventor: Jeremy Kemmerer, Holliston, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/425,550

(22) Filed: May 29, 2019

(51) Int. Cl.
*G10K 11/178* (2006.01)
*H04R 1/10* (2006.01)

(52) U.S. Cl.
CPC ..... *G10K 11/178* (2013.01); *H04R 1/1008* (2013.01); *G10K 2210/1081* (2013.01); *G10K 2210/3016* (2013.01); *H04R 2460/01* (2013.01)

(58) Field of Classification Search
None
See application file for complete search history.

(56) References Cited

U.S. PATENT DOCUMENTS

2013/0035893 A1* 2/2013 Grokop ..... H04L 67/22 702/141
2016/0302003 A1* 10/2016 Rahman ..... H04R 1/46
2017/0061951 A1* 3/2017 Starobin ..... H04R 27/00
2018/0240453 A1* 8/2018 Shibuya ..... G10K 11/178

* cited by examiner

*Primary Examiner* — Paul W Huber
(74) *Attorney, Agent, or Firm* — Patterson + Sheridan, LLP

(57) ABSTRACT

A method performed by a wearable audio output device worn by a user is provided for controlling the reproduction of external noise. At least one sound is detected in the vicinity of the audio output device using at least one microphone in the audio output device. A state of motion of the user is detected using at least one sensor in the audio output device. Based on the at least one sound and the state of motion of the user, at least one of a level of attenuation or a level of noise masking is determined to be applied by the audio output device to the external noise.

15 Claims, 4 Drawing Sheets

AUTOMATIC ACTIVE NOISE REDUCTION (ANR) CONTROL

FIELD

Aspects of the disclosure generally relate to controlling external noise in an audio output device, and more specifically to automatic Active Noise Reduction (ANR) control based on a user's acoustic environment and/or state of motion of the user.

BACKGROUND

Wearable audio output devices having noise cancelling capabilities have steadily increased in popularity. Modern headphones with ANR (sometimes referred to as active noise cancelling (ANC)) capabilities attenuate most sounds external to the headphones to provide an immersive audio experience to the user. However, a user may want to selectively set a level of attenuation of external sounds based on a user's environment and/or an activity being performed by the user. For instance, there may be certain situations when a user wearing the headphones with ANR turned on and may want to or need to hear certain external sounds for more situational awareness. On the other hand, there may be situations when the user may want the ANR to be set to a high level to attenuate most external sounds. While most ANR audio devices allow the user to manually turn on or turn off ANR, or even set a level of the ANR, there is a need for improvement for allowing a user to make an informed decision for setting a level of ANR.

SUMMARY

All examples and features mentioned herein can be combined in any technically possible manner.

Aspects of the present disclosure provide a method performed by a wearable audio output device worn by a user for controlling the reproduction of external noise. The method generally includes detecting at least one sound in the vicinity of the audio output device using at least one microphone in the audio output device; detecting a state of motion of the user using at least one sensor in the audio output device; and determining, based on the at least one sound and the state of motion of the user, at least one of a level of attenuation or a level of noise masking to be applied by the audio output device to the external noise.

In an aspect, the method further includes detecting, based on the at least one sound, whether the user is in a mode of transport.

In an aspect, detecting whether the user is in a mode of transport is based on a classifier model trained using training data including known sounds associated with a mode of transport.

In an aspect, the classifier model is configured to detect whether the user is in a mode of transport based on a feature set associated with the known sounds, wherein the feature set comprises at least one of a spectral slope, a spectral intercept, a coherence factor associated with the left and right ears of the user, a zero cross rate, a spectral centroid, a spectral energy, an auto correlation coefficient, a short time energy, or a spectral flux.

In an aspect, the state of motion comprises at least one of moving in a transport state, not moving or walking.

In an aspect, the at least one sensor comprises an accelerometer, and wherein detecting the state of motion includes detecting the state of motion of the user as a function of energy levels of signals detected by the accelerometer.

In an aspect, detecting the state of motion of the user includes detecting the state of motion of the user based on a classifier model trained using training data comprising known signals from the at least one sensor associated with the state of motion.

In an aspect, determining a level of attenuation for the external noise includes when the user is detected in a mode of transport and the state of motion is detected as moving in a transport state, setting the level of attenuation to a configured high level to attenuate the external noise.

In an aspect, wherein determining a level of attenuation for the external noise includes when the user is detected as not in a mode of transport and the state of motion is detected as walking, setting the level of attenuation to a configured low level to enable the user to hear sounds external to the audio output device.

In an aspect, the method further includes increasing an amplitude of at least a portion of the sounds external to the audio output device.

In an aspect, the at least one sensor comprises at least one of one or more accelerometers, one or more magnetometers or one or more gyroscopes.

In an aspect, the method further includes detecting, based on the at least one sound, at least one of whether the user is in a mode of transport, a particular non-user speaker speaking, noise from multiple non-user speakers speaking, or the user speaking.

Aspects of the present disclosure provide a wearable audio output device worn by the user for controlling the reproduction of external noise. The wearable audio output device generally includes at least one microphone for detecting sounds in the vicinity of the audio output device; at least one sensor for detecting at least one body movement of the user; noise controlling circuitry for attenuating the external noise; noise masking circuitry for generating masking sounds; at least one acoustic transducer for outputting audio; and at least one processor. The at least one processor is generally configured to detect at least one sound in the vicinity of the audio output device using the at least one microphone; detect a state of motion of the user using the at least one sensor; and determine, based on the at least one sound and the state of motion of the user, a level of attenuation to be applied by the noise controlling circuitry to the external noise or a level of noise masking to be applied by the noise masking circuitry.

In an aspect, the at least one processor is further configured to detect, based on the at least one sound, whether the user is in a mode of transport.

In an aspect, the state of motion comprises at least one of moving in a transport state, not moving or walking.

In an aspect, the at least one processor is configured to when the user is detected in a mode of transport and the state of motion is detected as moving in a transport state, set the level of attenuation to a configured high level to attenuate the external noise.

In an aspect, the at least one processor is configured to when the user is detected as not in a mode of transport and the state of motion is detected as walking, set the level of attenuation to a configured low level to enable the user to hear sounds external to the audio output device.

Aspects of the present disclosure provide an apparatus for controlling the reproduction of external noise in a wearable audio output device worn by a user. The apparatus generally includes at least one processor and a memory coupled to the at least one processor. The processor is generally configured to detect at least one sound in the vicinity of the audio output device using data from at least one microphone in the audio output device; detect a state of motion of the user using data from at least one sensor in the audio output device; and determine, based on the at least one sound and the state of motion of the user, at least one of a level of attenuation or a level of noise masking to be applied by the audio output device to the external noise.

In an aspect, the at least one processor is further configured to detect, based on the at least one sound, whether the user is in a mode of transport.

In an aspect, the state of motion comprises at least one of moving in a transport state, not moving or walking.

In an aspect, wherein the at least one processor is configured to when the user is detected in a mode of transport and the state of motion is detected as moving in a transport state, set the level of attenuation to a configured high level to attenuate the external noise.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

DETAILED DESCRIPTION

Aspects of the present disclosure provide methods for automatic, selective ANR control as a function of the user's environment and/or activities, as well as apparatuses and systems configured to implement these methods. As noted in the above paragraphs, a user of a wearable audio output device with active noise reduction capability (e.g., ANR/ANC headphones) may desire that ANR is adapted to suit the user's environment and/or activity being performed by the user. In certain aspects, the user may desire that ANR is continually and automatically adapted in real time based on the user's environment and/or activity. In certain aspects, the user may desire that the ANR level of the headphones is set as a function of sounds including noise in the vicinity of the user.

In an example use case, a user wearing headphones with ANR capability may desire that the ANR is set to a high level when the user is travelling in a mode of transport (e.g., bus, train, airplane etc.) in order to attenuate noises related to the mode of transport including engine noise, wind noise, general noise from other passengers speaking or the like. In an aspect, attenuating external sounds allows the user to listen to audio content being played by the headphone speakers at a lower volume without hearing unwanted sounds, thus achieving a better overall audio experience.

Additionally or alternatively, the user may desire that the ANR level is set as a function of a state of motion of the user including walking, moving (e.g., being in a moving mode of transport) or not moving. For example, the user may desire that the ANR is set to a low level or turned off when the user is walking, so that the user is aware of the user's surroundings and may avoid potential hazards including traffic. On the other hand, the user may desire that the ANR is set to a high setting when travelling in a mode of transport, for example, in order to listen to music.

Certain aspects of the present disclosure discuss techniques for selectively setting ANR levels (or a level of noise masking) automatically based on a user's acoustic environment and/or one or more activities being performed by the user by leveraging sensors in a wearable audio output device. In an aspect, the sensors may include at least one of one or more microphones, one or more accelerometers, one or more magnetometers, or one or more gyroscopes.

Figure 1:
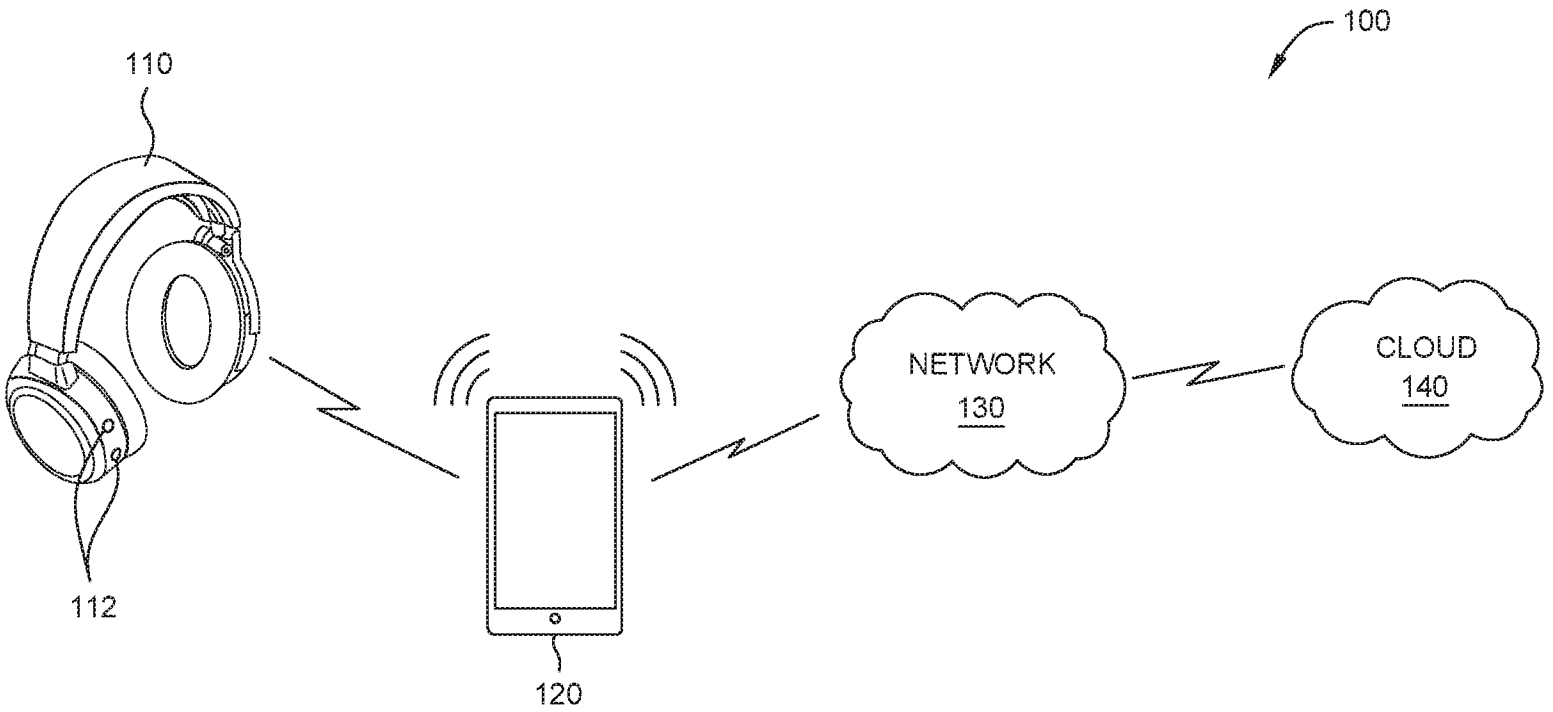
FIG. 1 illustrates an example system in which aspects of the present disclosure may be practiced.

FIG. 1 illustrates an example system 100 in which aspects of the present disclosure may be practiced.

As shown, system 100 includes a pair of headphones 110 communicatively coupled with a portable user device 120. In an aspect, the headphones 110 may include one or more microphones 112 to detect sound in the vicinity of the headphones 110. The headphones 110 also include at least one acoustic transducer (also known as driver or speaker) for outputting sound. The included acoustic transducer(s) may be configured to transmit audio through air and/or through bone (e.g., via bone conduction, such as through the bones of the skull). The headphones 110 may further include hardware and circuitry including processor(s)/processing system and memory configured to implement one or more sound management capabilities or other capabilities including, but not limited to, noise cancelling circuitry (not shown) and/or noise masking circuitry (not shown), body movement detecting devices/sensors and circuitry (e.g., one or more accelerometers, one or more gyroscopes, one or more magnetometers, etc.), geolocation circuitry and other sound processing circuitry. The noise cancelling circuitry is configured to reduce unwanted ambient sounds external to the headphones 110 by using active noise cancelling. The noise masking circuitry is configured to reduce distractions by playing masking sounds via the speakers of the headphones 110. The movement detecting circuitry is configured to use devices/sensors such as an accelerometer, gyroscope, magnetometer, or the like to detect whether the user wearing the headphones is moving (e.g., walking, running, in a moving mode of transport etc.) or is at rest and/or the direction the user is looking or facing. The movement detecting circuitry may also be configured to detect a head position of the user for use in augmented reality (AR) applications where an AR sound is played back based on a direction of gaze of the user. The geolocation circuitry may be configured to detect a physical location of the user wearing the headphones. For example, the geolocation circuitry includes Global Positioning System (GPS) antenna and related circuitry to determine GPS coordinates of the user.

In an aspect, the headphones 110 include voice activity detection (VAD) circuitry capable of detecting the presence of speech signals (e.g. human speech signals) in a sound signal received by the microphones 112 of the headphones 110. For instance, as shown in FIG. 1, the microphones 112 of the headphones 110 may receive ambient external sounds in the vicinity of the headphones 110, including speech uttered by a non-user subject. Thus, the sound signal received by the microphones 112 has the speech signal mixed in with other sounds in the vicinity of the headphones 110. Using the VAD, the headphones 110 may detect and extract the speech signal from the received sound signal.

In an aspect, the headphones 110 are wirelessly connected to the portable user device 120 using one or more wireless communication methods including but not limited to Bluetooth, Wi-Fi, Bluetooth Low Energy (BLE), other radio frequency (RF)-based techniques, or the like. In an aspect, the headphones 110 includes a transceiver that transmits and receives information via one or more antennae to exchange information with the user device 120.

In an aspect, the headphones 110 may be connected to the portable user device 120 using a wired connection, with or without a corresponding wireless connection. As shown, the user device 120 may be connected to a network 130 (e.g., the Internet) and may access one or more services over the network. As shown, these services may include one or more cloud services 140.

The portable user device 120 is representative of a variety of computing devices, such as mobile telephone (e.g., smart phone) or a computing tablet. In an aspect, the user device 120 may access a cloud server in the cloud 140 over the network 130 using a mobile web browser or a local software application or "app" executed on the user device 120. In an aspect, the software application or "app" is a local application that is installed and runs locally on the user device 120. In an aspect, a cloud server accessible on the cloud 140 includes one or more cloud applications that are run on the cloud server. The cloud application may be accessed and run by the user device 120. For example, the cloud application may generate web pages that are rendered by the mobile web browser on the user device 120. In an aspect, a mobile software application installed on the user device 120 and a cloud application installed on a cloud server, individually or in combination, may be used to implement the techniques for keyword recognition in accordance with aspects of the present disclosure.

It may be noted that although certain aspects of the present disclosure discuss automatic ANR control in the context of headphones 110 for exemplary purposes, any wearable audio output device with similar capabilities may be interchangeably used in these aspects. For instance, a wearable audio output device usable with techniques discussed herein may include over-the-ear headphones, audio eyeglasses or frames, in-ear buds, around-ear audio devices, or the like.

Figure 2:
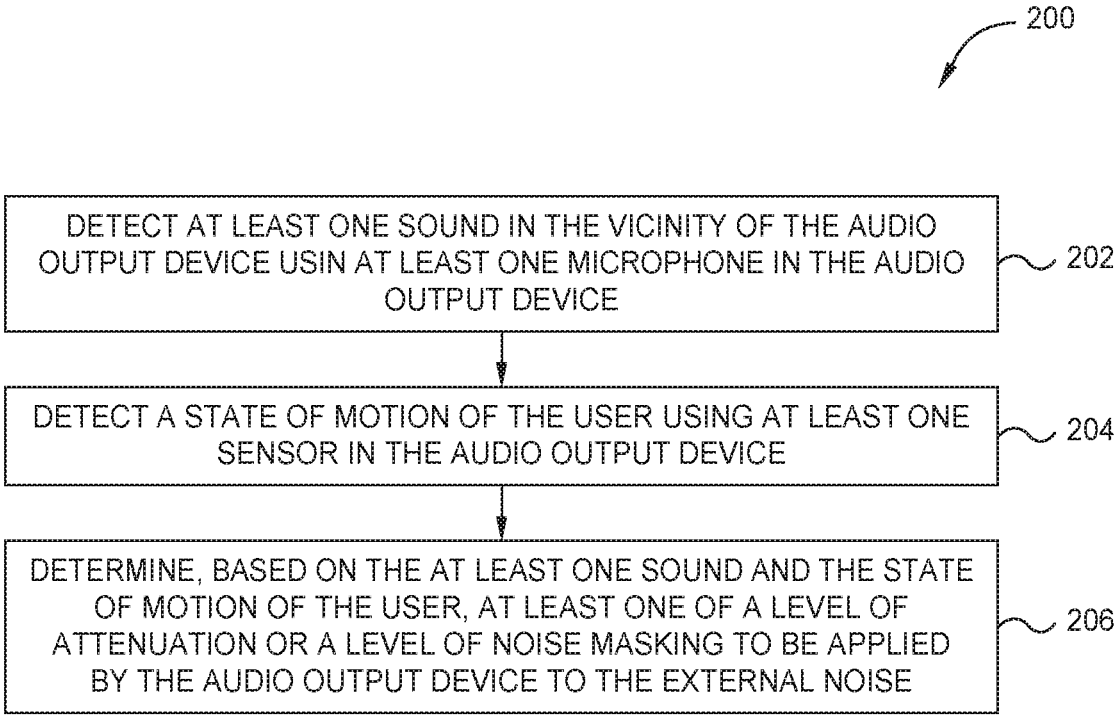
FIG. 2 illustrates example operations performed by a wearable audio output device worn by a user for controlling external noise, in accordance with certain aspects of the present disclosure.

FIG. 2 illustrates example operations 200 performed by a wearable audio output device (e.g., headphones 110 as shown in FIG. 1) worn by a user for controlling external noise, in accordance with certain aspects of the present disclosure. Operations 200 begin, at 202, by detecting at least one sound in the vicinity of the audio output device using at least one microphone in the audio output device. At 204, the audio output device detects a state of motion of the user using at least one sensor in the audio output device. At 206, the audio output device determines, based on the at least one sound and the state of motion of the user, a level of attenuation or a level of noise masking to be applied by the audio output device to the external noise.

In certain aspects, the ambient sounds/noise detected in the vicinity of the headphones (e.g., by one or more microphones on the headphone) may be used to determine information relating to the user's acoustic environment such as whether the user is in a mode of transport (e.g., bus, train, airplane, etc.) based on recognizing sounds/noise typical of the mode of transport.

In certain aspects, one more classifier models may be used to determine the information relating to the user's acoustic environment. Each classifier model may be trained with training data relating to sounds associated with the acoustic environment to be detected by the classifier model. For example, a classifier model may be trained with a set of acoustic features relating to known sounds associated with several modes of transport. Once the classifier model is trained, it may determine a transport class (e.g., whether the user is in a mode of transport) based on the same trained set of features extracted from candidate real time sounds detected in the vicinity of the headphones. In an aspect, a different classifier model may be used for determining different types of acoustic information related to the user's acoustic environments.

In certain aspects, an extraction algorithm may extract plurality of acoustic features from sounds/noise detected in the vicinity of the headphones. Each classifier model may use a subset of the extracted features, same as the subset of features that the classifier model was trained with, for its classification operation. In an aspect, the plurality of features may include at least one of spectral slope, spectral intercept, a coherence factor between the left and right sides of the headphone, zero cross rate, spectral centroid, spectral energy in specific band(s), auto correlation coefficients, short time energy, or spectral flux. It may be noted that this list of acoustic features is non-exhaustive and that one or more other features may be used for each of the classification operations.

In an aspect, the time domain features including zero cross rate, auto correlation coefficients and short time energy may be computed on a frame of size 256 samples. Zero crossing rate counts the number of times the signal crosses zero. Auto correlation coefficients may be computed for each frame over a maximum lag of 16 ms (768 samples) for each frame, and the maximum for each frame may be stored and used as a feature. Short-time energy may be computed as the total energy of the frame (mean of the square of the signal), converted to decibels, dB. All spectral features including spectral slope, spectral intercept, coherence factor, spectral centroid, spectral energy and spectral flux may be based on Fast Fourier Transforms (FFTs) on frames of length 256. The features spectral centroid, spectral energy and spectral flux may be computed from a single frame, and the features spectral slope, spectral intercept and coherence factor may be computed after averaging several frames. Spectral slope and intercept may be computed by taking a linear regression of an average power spectrum (e.g., averaged over 8 consecutive frames) after converting to dB. Left-Right side coherence may be computed by using two signals, one from microphone from each side of the headset, and computing cross and auto spectra (averaged over 8 frames), which may be used to estimate the "magnitude squared coherence: $C=|Pxy|^2/(Pxx*Pyy)$. The Left-Right side coherence feature may then be computed by summing the coherence of the bins up to about 250 Hz. Spectral energy may be computed by summing the energy of the power spectrum over a specific range of frequencies (e.g., low frequency, <500 Hz). Spectral flux may be computed by taking the sum over frequency of the difference of the magnitude spectra from adjacent frames, and by converting to log scale. Spectral centroid may be computed by taking the average of the magnitude of the spectrum times frequency, normalized by the average of the magnitude spectrum.

In an aspect, the detected state of motion of the user may include at least one of walking, running, motion related to a moving mode of transport (e.g., when the user is in a moving bus, train or airplane), or not moving. In as aspect, the state of motion may be detected using at least one sensor configured in the headphones including but not limited to one or more accelerometers, one or more magnetometers, or one or more gyroscopes, or an inertial measurement unit (IMU) including a combination of these sensors.

In an aspect, each state of motion or activity of the user may be detected by using a classifier model trained to detect the state of motion. Each classifier model may be trained based on sensor training data related to the state of motion or activity to be detected by the classifier model. Additionally or alternatively, one or more of the states of motion may be detected by measuring energies associated with signals from one or more of the sensors. For instance, the energy of signals from the accelerometer sensor may be used to determine whether the user is moving, and if moving, whether the user is walking/running or the motion is related to the user being in a moving mode of transport. In an aspect, only one axis (e.g., x axis) of a 3 axis accelerometer may be used for the activity detection. When the energy from the accelerometer signal is below a threshold, the user may be determined as not moving. When the energy from the accelerometer signal is above the threshold, the user is determined as moving. However, motion related to walking/running needs to be distinguished from motion related to user being in a moving mode of transport. Walking/running generally includes several energy peaks in a given time period. Thus, the user may be determined as walking or running when periodic energy peaks are detected. Otherwise, the user's motion is determined as related to the user being in a moving mode of transport.

In certain aspects, decisions regarding a level of attenuation to set for the ANR (or a level of noise masking to be set) may be based on the detected acoustic environment of the user, the detected state of motion or activity of the user, or a combination thereof.

In certain aspects, to avoid detection of false positives or false negatives, the ANR control algorithm may use a combination of sound/noise detection based on microphone input and state of motion detection based on sensor input (e.g., IMU sensor), to determine a level of the ANR (or noise masking) to be set. In an aspect, using a combination of noise/sound detection and state of motion detection ensures that a correct state related to the user's environment is detected. For instance, when a noise/sound detection algorithm (e.g., classifier model) detects that the user is in a mode of transport, and when an algorithm configured to detect the user's state of motion (e.g., classifier model or sensor energy based algorithm) simultaneously detects that the user's motion is related to the user being in a moving mode of transport, the chances of the determination being correct are much higher as compared to the determination being made based on only one of the inputs.

Figure 3:
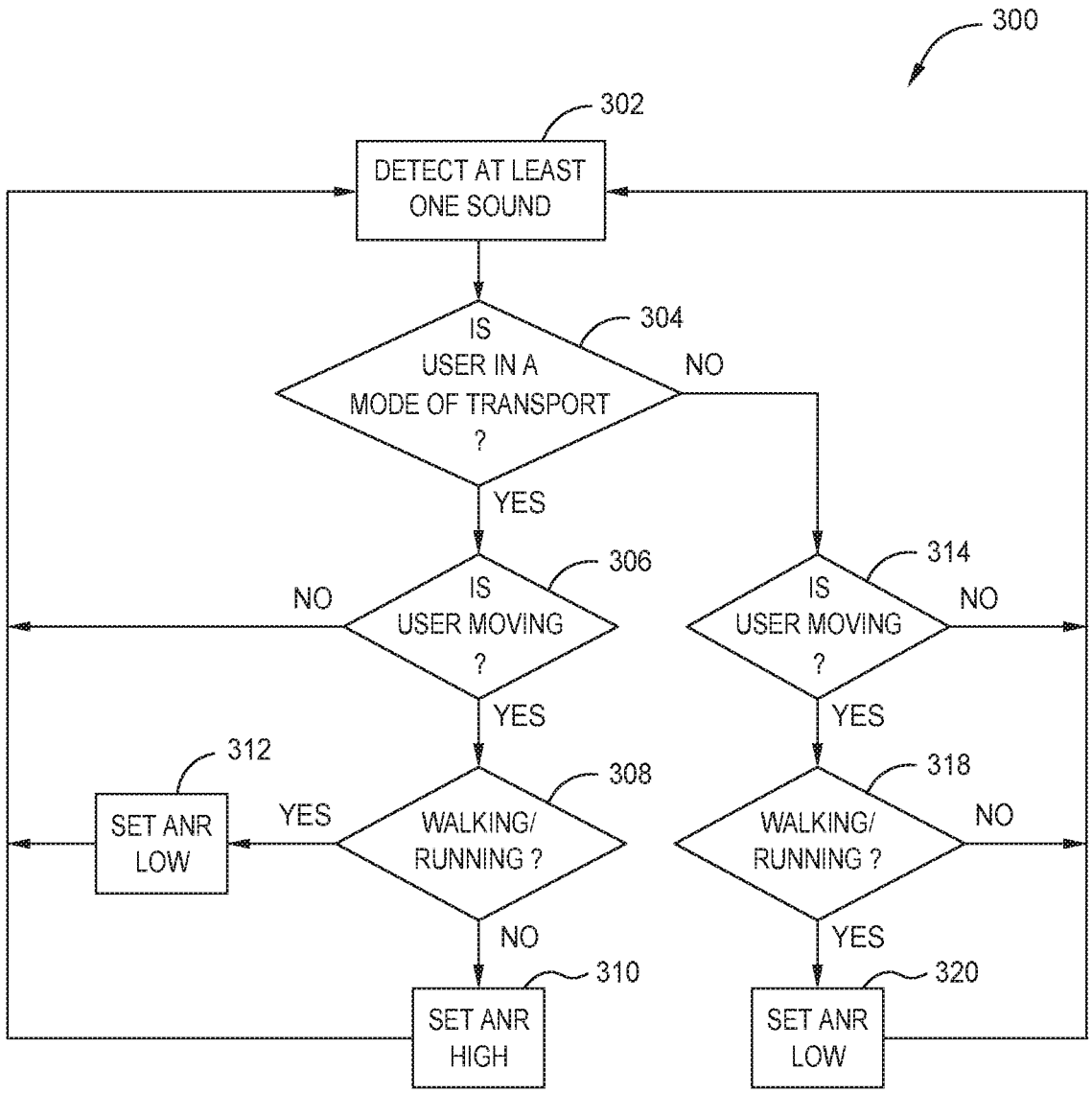
FIG. 3 illustrates example operations for ANR control based on a combination of sound/noise detection and state of motion detection, in accordance with certain aspects of the present disclosure.

FIG. 3 illustrates example operations 300 for ANR control based on a combination of sound/noise detection and state of motion detection, in accordance with certain aspects of the present disclosure.

Operations 300 begin, at 302, by detecting at least one sound in the vicinity of a user by using at least one microphone configured in a wearable audio output device (e.g., headphones 110 of FIG. 1) worn by the user. At 304, it is determined whether the user is in a mode of transport. In an aspect, a trained classifier model may be used to make this determination. If the user is determined as being in a mode of transport, it is determined whether the user is moving at 306. If it is determined that the user is moving, it is further determined at 308 whether the detected motion is related to the user walking/running. In an aspect, one or more sensors (e.g., IMU sensor) may be used to detect at least one body movement of the user, and the state of motion (e.g., the user moving/walking/running) of the user may be determined based on the detected at least one body movement. In an aspect, the determination of the user's state of motion may be based on energies detected by the one or more sensors or based on a trained classifier model. If it is determined that the user is not walking/running at 308, the algorithm assumes that the motion detected at 306 is related to the user being in a mode of transport, and in response, the ANR is set to a high level (e.g., a preconfigured high level) in order to attenuate most sounds external to the headphones. On the other hand, if it is determined at 308 that the user is walking/running, the ANR is set to a low setting (e.g., a preconfigured low setting) or completely turned off to allow the user a higher level of situational awareness. In an aspect, this situation may apply to a case when the user is walking within a mode of transport and needs a higher situational awareness.

At 306, if it is determined that the user is not moving in contradiction to the determination at 304 that the user is in a moving mode of transport, the algorithm assumes that an ambiguous state has occurred and returns back to the initial state 302. In an aspect, a level of ANR currently set is maintained.

At 304, in response to determining that the user is not in a mode of transport, it is determined at 314 whether the user is moving. If the user is detected as moving at 314, it is further determined at 318 whether the user is walking/running. If it is detected at 318 that the user's motion detected at 314 is related to the user walking/running, the ANR is set to a low setting or completely turned off at 320 to allow the user a higher level of situational awareness. On the other hand, if it is determined that the user's motion detected at 314 is not related to the user walking/running, the algorithm assumes an ambiguous state has occurred and returns back to the initial state 302 in order to continue to attempt to detect sounds in the vicinity of the user. Similarly, if it is determined that the user is not moving at all at 314, the algorithm assumes an ambiguous state has occurred and returns back to the initial state 302 in order to continue to attempt to detect sounds in the vicinity of the user. In an aspect, the algorithm maintains a currently set ANR level when an ambiguous state is detected.

In certain aspects, as illustrated by the algorithm of FIG. 3, using a combination of microphone input and sensor input (e.g., IMU sensor input) allows for a more accurate detection of the user's acoustic environment and/or the user's state of motion. For example, when the algorithm detects at 304 based on microphone input that the user is in a mode of transport, this detection is confirmed when it is detected at 306 and 308 based on the IMU sensor that the user is in motion that is not related to the user walking or running. Further, when the algorithm detects at 304 that the user is not in a mode of transport, this detection is confirmed when it is detected at 314 and 318 based on the IMU sensor that the user is walking or running.

In an aspect, when using a combination of microphone input and IMU input for ANR control, the algorithm determines an acoustic environment of the user is detected based on microphone input is correct, only after the IMU detects a user's state of motion matching with the detected acoustic environment for a pre-configured time period. For example, when the algorithm of FIG. 3 detects at 304 that the user is in a mode of transport, the ANR is set to a high level at 310 only if the algorithm simultaneously detects a user motion not relating to the user walking/running for N consecutive seconds. Similarly, when the algorithm of FIG. 3 detects at 304 that the user is not in a mode of transport, the ANR is set to a low level at 320 only if the algorithm simultaneously detects a user motion relating to the user walking/running for N consecutive seconds.

In certain aspects, sound inputs (e.g., from one or more microphones) and sensor inputs (e.g., from accelerometer, magnetometer, gyroscope etc.) are continually analyzed and decisions regarding a level of noise reduction to be set are taken in real time as changes in the user's acoustic environment and/or user activities are detected, and the noise reduction levels are set automatically to suit the detected acoustic environment and/or user activity. In an aspect, the user may configure how the ANR is set for particular acoustic environments, activities or combinations thereof using a software application on the user device (e.g., user device 120 in FIG. 1). This is also illustrated in the algorithm of FIG. 3. As shown in FIG. 3, after setting the ANR to a high setting at 310 or after setting the ANR to a low setting at 320, the algorithm is returned to process block 302 where the algorithm attempts to detect a sound in the vicinity of the user.

Figure 4:
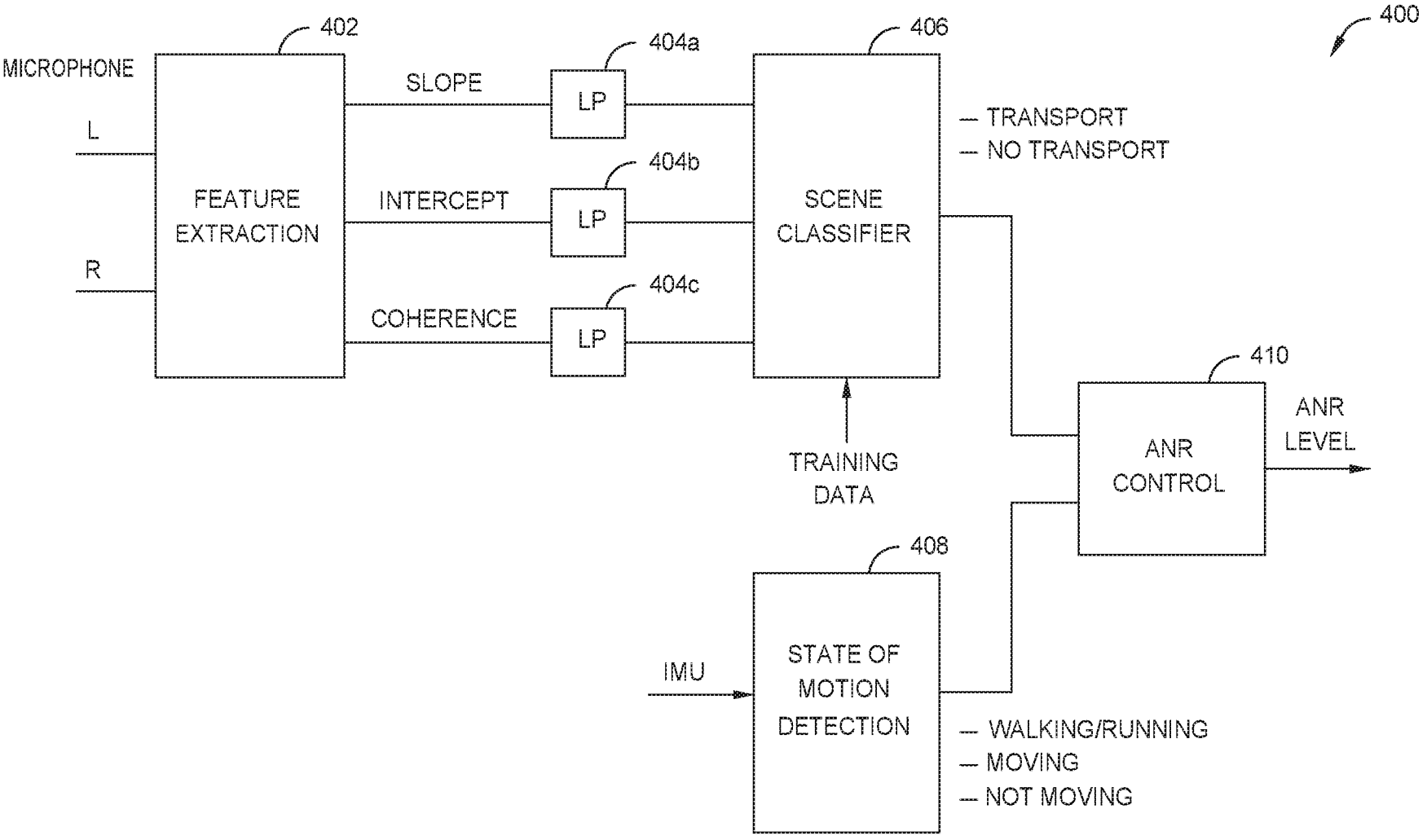
FIG. 4 illustrates an example implementation of automatic noise control, in accordance with certain aspects of the present disclosure.

FIG. 4 illustrates an example implementation system 400 of automatic noise control, in accordance with certain aspects of the present disclosure. In an aspect, the system 400 may be implemented in the headphones, in the user device, or a combination thereof.

As shown in FIG. 4, the system 400 includes a feature extraction module 402, a scene classifier module 406, a state of motion detection module 408 and ANR control module 410. In an aspect, the feature extraction module 402 and the scene classifier module 406, in combination, are configured to determine an acoustic environment of the user including whether the user is in a mode of transport. The state of motion detection module 408 is configured to detect a state of motion of the user including whether the user is walking/running, moving (e.g., in a moving mode of transport), or not moving.

As shown, the feature extraction module 402 accepts microphone input from one or more microphones, for example, from a wearable audio output device such as headphones worn by a user. In an aspect the microphone input may include inputs from microphones placed on the left and right ear cups of the headphones. In an aspect, the microphone input incudes a sound signal related to a sound detected by the one or more microphones in the headphones. The feature extraction module 402 is configured to extract one or more acoustic features from the sound signal, for use in detecting the user's acoustic environment. As discussed in the above paragraphs, the acoustic features may include one or more of spectral slope, spectral intercept, a coherence factor between the left and right sides of the headphone, zero cross rate, spectral centroid, spectral energy in specific band(s), auto correlation coefficients, short time energy, or spectral flux. It may be noted that this is not an exhaustive list of acoustic features and that the feature extraction module 402 may be configured to identify other acoustic features not included in this list of acoustic features.

In an aspect, since sounds/noise generally associated with modes of transport (e.g., buses, trains, airplanes etc.) are in the lower frequency range, the feature extraction module 402 samples the sound signal in a lower range of frequencies (e.g., <500 Hz). In an aspect, the feature extraction module uses frames with a frame size of 256 samples, wherein the samples are extracted from a lower frequency range of the received sound signal.

As shown in FIG. 4, for the scene classification, the scene classifier module 406 uses three of the acoustic features extracted by the feature extraction module 402, including spectral slope, spectral intercept and coherence factor. It may be noted that the scene classifier may use any single acoustic feature or any combination of two or more acoustic features from a plurality of acoustic features extracted by the feature extraction module 402. As shown in FIG. 4, each of the extracted features is passed through a low pass filter (404*a*-404*c*) before feeding into the scene classifier module 406. In an aspect, each low pass filter passes lower frequency components while cutting out the higher frequency components of the features.

In an aspect, coherence is generally a measure of how closely two signals are related as a function of frequency. Coherence at low frequency is generally high inside a transport vehicle (with little or no wind). Likewise, spectral slope and intercept are sensitive to the same low-frequency energy present from motion of a train or bus and sound energy generated by an engine. In an aspect, the feature extraction module uses microphone inputs from both right and left ears to calculate the coherence factor.

The scene classifier module 406 uses a combination of the spectral slope, spectral intercept and coherence factor to determine whether the user is in a mode of transport. In an aspect, the scene classifier module 406 is a binary tree classifier. As discussed in the above paragraphs, the scene classifier module 406 may be trained using training data relating to sounds associated with several modes of transport (e.g., buses, trains, airplanes etc.). Further, the scene classifier module 406 is trained using the same combination of three features related to known sounds associated with different modes of transport. In an aspect, once the scene classifier model 406 is trained, it may determine a transport class (e.g., whether the user is in of transport) based on the same trained set of three features extracted from candidate real time sounds signal fed to the system.

In an aspect, the state of motion detection module 408 is configured to simultaneously detect a state of motion of the user based on input from an IMU device in the headphones. In an aspect, the state of motion detection module 408 may detect one or more states of motion by measuring energies associated with signals from one or more of the sensors of the IMU device. For instance, the energy of signals from the accelerometer sensor of the IMU device may be used to determine whether the user is moving, and if moving, whether the user is walking/running or the motion is related to the user being in a moving mode of transport. In an aspect, only one axis (e.g., x axis) of a 3 axis accelerometer may be used for the activity detection. When the energy from the accelerometer signal is below a threshold, the user may be determined as not moving. When the energy from the accelerometer signal is above the threshold, the user is determined as moving. However, motion related to walking/running needs to be distinguished from motion related to user being in a moving mode of transport. Walking/running generally includes several energy peaks in a given time period. Thus, the user may be determined as walking or running when periodic energy peaks are detected. Otherwise, the user's motion is determined as related to the user being in a moving mode of transport.

As shown in FIG. 4, the information relating to the acoustic environment/scene of the user as determined by the scene classifier module 406, and the information relating to the state of motion of the user as determined by the state of motion detection module 408 is fed into the ANR control module 410. The ANR control module 410 is configured to determine an ANR level to be set for the headphones based on the acoustic environment/scene of the user and the state of motion of the user. In an aspect, when the ANR control module 410 detects that the user is in a mode of transport and simultaneously detects a user motion not relating to the user walking/running for N consecutive seconds, the ANR control module 410 sets the ANR to a pre-configured high level. Similarly, when ANR control module 410 detects that the user is not in a mode of transport, and simultaneously detects a user motion relating to the user walking/running for N consecutive seconds, the ANR control module 410 sets the ANR to a low level.

In an aspect, sound inputs (e.g., from one or more microphones) and sensor inputs (e.g., from accelerometer, magnetometer, gyroscope etc.) are continually analyzed by the system 400 and decisions regarding a level of noise reduction to be set are taken in real time as changes in the user's acoustic environment and/or user activities are detected, and the noise reduction levels are set automatically to suit the detected acoustic environment and/or user activity.

In an aspect, the ANR control module 410 may be configured to determine the ANR level based on outputs from any one of the different classifier modules or a combination of outputs from any two or more of the different classifier modules.

It may be noted that the processing related to the automatic ANR control as discussed in aspects of the present disclosure may be performed natively in the headphones, by the user device or a combination thereof.

It can be noted that, descriptions of aspects of the present disclosure are presented above for purposes of illustration, but aspects of the present disclosure are not intended to be limited to any of the disclosed aspects. Many modifications and variations will be apparent to those of ordinary skill in the art without departing from the scope and spirit of the described aspects.

In the preceding, reference is made to aspects presented in this disclosure. However, the scope of the present disclosure is not limited to specific described aspects. Aspects of the present disclosure can take the form of an entirely hardware embodiment, an entirely software embodiment (including firmware, resident software, micro-code, etc.) or an embodiment combining software and hardware aspects that can all generally be referred to herein as a "component," "circuit," "module" or "system." Furthermore, aspects of the present disclosure can take the form of a computer program product embodied in one or more computer readable medium(s) having computer readable program code embodied thereon.

Any combination of one or more computer readable medium(s) can be utilized. The computer readable medium can be a computer readable signal medium or a computer readable storage medium. A computer readable storage medium can be, for example, but not limited to, an electronic, magnetic, optical, electromagnetic, infrared, or semiconductor system, apparatus, or device, or any suitable combination of the foregoing. More specific examples a computer readable storage medium include: an electrical connection having one or more wires, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the current context, a computer readable storage medium can be any tangible medium that can contain, or store a program.

The flowchart and block diagrams in the Figures illustrate the architecture, functionality and operation of possible implementations of systems, methods and computer program products according to various aspects. In this regard, each block in the flowchart or block diagrams can represent a module, segment or portion of code, which comprises one or more executable instructions for implementing the specified logical function(s). In some alternative implementations the functions noted in the block can occur out of the order noted in the figures. For example, two blocks shown in succession can, in fact, be executed substantially concurrently, or the blocks can sometimes be executed in the reverse order, depending upon the functionality involved. Each block of the block diagrams and/or flowchart illustrations, and combinations of blocks in the block diagrams and/or flowchart illustrations can be implemented by special-purpose hardware-based systems that perform the specified functions or acts, or combinations of special purpose hardware and computer instructions.

What is claimed is:

1. A method performed by a wearable audio output device worn by a user for controlling the reproduction of external noise and audio, comprising:

detecting at least one sound in the vicinity of the wearable audio output device using at least two microphones in the wearable audio output device;

detecting a state of motion of the user using at least one sensor in the wearable audio output device;

determining, based on inputting the at least one sound to a classifier model, whether the user is in a mode of transport, wherein the classifier model is configured to detect whether the user is in a mode of transport based on a coherence factor associated with the two microphones; and determining, based on whether the user is in a mode of transport and the state of motion of the user, at least one of a level of attenuation applied by the wearable audio output device to the external noise or adjusting a level of noise masking output by the wearable audio output device.

2. The method of claim 1, wherein the state of motion comprises at least one of moving in a transport state, not moving or walking.

3. The method of claim 2, wherein the at least one sensor comprises an accelerometer, and wherein detecting the state of motion comprises:

detecting the state of motion of the user as a function of energy levels of signals detected by the accelerometer.

4. The method of claim 2, wherein detecting the state of motion of the user comprises:

detecting the state of motion of the user based on another classifier model trained using training data comprising known signals from the at least one sensor associated with the state of motion.

5. The method of claim 2, wherein determining the level of attenuation applied by the wearable audio output device to the external noise comprises:

when the user is detected in the mode of transport and the state of motion is detected as moving in the transport state, setting the level of attenuation to a configured high level to attenuate the external noise.

6. The method of claim 2, wherein determining the level of attenuation applied by the wearable audio output device to the external noise comprises:

when the user is detected as not in the mode of transport and the state of motion is detected as walking, setting the level of attenuation to a configured low level to enable the user to hear sounds external to the audio output device.

7. The method of claim 6, further comprising:

increasing an amplitude of at least a portion of the sounds external to the audio output device.

8. The method of claim 1, wherein the at least one sensor comprises at least one of one or more accelerometers, one or more magnetometers or one or more gyroscopes.

9. A wearable audio output device worn by a user for controlling the reproduction of external noise and audio, comprising:

at least two microphones for detecting sounds in the vicinity of the wearable audio output device;

at least one sensor for detecting at least one body movement of the user;

noise controlling circuitry for attenuating the external noise;

noise masking circuitry for generating masking sounds;

at least one acoustic transducer for outputting audio; and at least one processor configured to:

detect at least one sound in the vicinity of the wearable audio output device using the at least two microphones;

detect a state of motion of the user using the at least one sensor;

determine, based on inputting the at least one sound to a classifier model, whether the user in a mode of transport, wherein the classifier model is configured to detect whether the user is in the mode of transport based on a coherence factor associated with the two microphones; and determine, based on whether the user is in a mode of transport and the state of motion of the user, at least one of a level of attenuation to be applied by the noise controlling circuitry to the external noise or a level of noise masking to be output by the noise masking circuitry.

10. The wearable audio output device of claim 9, wherein the state of motion comprises at least one of moving in a transport state, not moving or walking.

11. The wearable audio output device of claim 10, wherein the at least one processor is configured to:

when the user is detected in the mode of transport and the state of motion is detected as moving in the transport state, set the level of attenuation to a configured high level to attenuate the external noise.

12. The wearable audio output device of claim 10, wherein the at least one processor is configured to:

when the user is detected as not in the mode of transport and the state of motion is detected as walking, set the level of attenuation to a configured low level to enable the user to hear sounds external to the audio output device.

13. An apparatus for controlling the reproduction of external noise and audio in a wearable audio output device worn by a user, comprising:

at least one processor configured to:

detect at least one sound in the vicinity of the wearable audio output device using data from at least two microphones in the wearable audio output device;

detect a state of motion of the user using data from at least one sensor in the wearable audio output device; and determine, based on inputting the at least one sound to a classifier model, whether the user is in a mode of transport, wherein the classifier model is configured to detect whether the user is in a mode of transport based on a coherence factor associated with the two microphones; and determining, based on whether the user is in a mode of transport and the state of motion of the user, at least one of a level of attenuation applied by the wearable audio output device to the external noise or adjusting a level of noise masking by the wearable audio output device.

14. The apparatus of claim 13, wherein the state of motion comprises at least one of moving in a transport state, not moving or walking.

15. The apparatus of claim 14, wherein the at least one processor is configured to:

when the user is detected in the mode of transport and the state of motion is detected as moving in a transport state, set the level of attenuation to a configured high level to attenuate the external noise.

* * * * *